US011095973B1

(12) United States Patent
Zalisk et al.

(10) Patent No.: US 11,095,973 B1
(45) Date of Patent: Aug. 17, 2021

(54) NOZZLE OF AN IN-EAR AUDIO DEVICE INCLUDING A FLEXIBLE PORTION AND A RIGID PORTION

(71) Applicant: BOSE CORPORATION, Framingham, MA (US)

(72) Inventors: Michael Andrew Zalisk, Arlington, MA (US); Caleb Drake, Allston, MA (US); Ryan Joseph Wexler, Boston, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/901,779

(22) Filed: Jun. 15, 2020

(51) Int. Cl.
*H04R 1/10* (2006.01)
*G10K 11/175* (2006.01)

(52) U.S. Cl.
CPC ..... *H04R 1/1083* (2013.01); *G10K 11/175* (2013.01); *H04R 1/1016* (2013.01); *H04R 1/1066* (2013.01); *H04R 1/1075* (2013.01); *H04R 2420/07* (2013.01); *H04R 2460/01* (2013.01)

(58) Field of Classification Search
CPC ..... H04R 25/60; H04R 25/65; H04R 25/656; H04R 25/456; H04R 25/652; H04R 25/658; H04R 25/604; H04R 2225/025; H04R 5/033; H04R 1/1083; H04R 1/1016; H04R 1/1058; H04R 1/1075; H04R 1/1066; H04R 2201/107; H04R 2420/07; H04R 2460/01; G10K 2210/108; G10K 2210/1081; G10K 2210/3045; G10K 2210/112; G10K 2210/12822; G10K 11/1788; G10K 11/175; F01N 1/065
USPC ..... 381/71.1, 71.6, 71.7, 380, 328, 322
See application file for complete search history.

(56) References Cited

U.S. PATENT DOCUMENTS

| | | | | |
|---|---|---|---|---|
| 8,712,087 | B2 * | 4/2014 | Ozawa | H04R 1/1016 381/380 |
| 2015/0036861 | A1 * | 2/2015 | Cotha | H04R 1/1058 381/380 |
| 2015/0382094 | A1 * | 12/2015 | Grinker | H04R 1/1058 381/380 |
| 2016/0192058 | A1 * | 6/2016 | Kelly | H04R 1/1066 381/87 |
| 2018/0098146 | A1 * | 4/2018 | Lin | H04R 1/1083 |
| 2020/0107110 | A1 * | 4/2020 | Ji | A45C 11/00 |

* cited by examiner

*Primary Examiner* — Ahmad F. Matar
*Assistant Examiner* — Sabrina Diaz
(74) *Attorney, Agent, or Firm* — Patterson + Sheridan, LLP

(57) ABSTRACT

Aspects describe a nozzle including a first flexible portion and a second rigid portion. The rigid portion is less flexible than the flexible portion. When positioned in a user's ear, the flexible portion extends a section of the earbud housing towards an ear canal of a user and the rigid portion couples a removable sealing structure to the earbud housing. In aspects, the flexible portion provides comfort by allowing a sealing structure to flex and accommodate a wearer's ear and the rigid portion provides structure for the feedback microphone to be placed close to the user's ear canal for ANR.

20 Claims, 7 Drawing Sheets

NOZZLE OF AN IN-EAR AUDIO DEVICE INCLUDING A FLEXIBLE PORTION AND A RIGID PORTION

FIELD

Aspects of the present disclosure describe various features of a nozzle of an in-ear audio device. The nozzle includes a first flexible portion and a second rigid portion. The flexible portion extends a section of the housing towards the ear canal (when placed in a user's ear) and the rigid portion couples an ear tip of the in-ear audio device to housing.

BACKGROUND

People use in-ear audio output devices for long periods of time and while they engage in various types of activity. As an example, people wear in-ear audio devices throughout the day as they engage in a variety of activities including commuting, working, and exercising. The functionality provided by in-ear audio devices continues to improve due to advancements in technology and the ability of the in-ear audio devices to communicate with the Internet and smart devices. As such, in-ear audio devices are becoming more integral in people's daily lives. Given the use and popularity of in-ear audio devices, it is desirable for earpieces to comfortably stay in the user's ear while offering a variety of audio functionality including, for example, active noise reduction (ANR).

SUMMARY

Aspects provide an in-ear audio device with ANR capabilities. More specifically, aspects provide a nozzle including a first flexible portion and a second rigid portion. The flexible portion helps to provide comfort and stability for the in-ear audio device for a variety of ear sizes and geometries. For example, the flexible portion allows a sealing structure to flex to accommodate the user's ear geometry. The rigid portion provides support for a feedback microphone to be placed in the user's ear canal such that the feedback microphone hears the signal in the same way the user does. Because the feedback microphone is placed close to the ear drum, it is well positioned to hear what the user hears. In response, the in-ear audio device is well-adapted to perform ANR to correct the audio output signal.

Certain aspects provide an in-ear audio device comprising an ear tip and an earbud housing. The earbud housing comprises a nozzle portion, wherein the nozzle portion comprises a first flexible portion and a second rigid portion. The first flexible portion extends a section of the earbud housing towards an ear canal of a user, and the second rigid portion couples the ear tip to the earbud housing.

In aspects, the in-ear audio device further comprises a feedback microphone mounted on an inner surface of the second rigid portion. In aspects, the in-ear audio device further comprises an acoustic driver acoustically coupled to the feedback microphone and mounted on the inner surface of the second rigid portion. In aspects, the in-ear audio device further comprises an acoustic driver mounted in the earbud housing.

In aspects, the in-ear audio further comprises a rigid attachment piece coupling the first flexible portion to the earbud housing, wherein the rigid attachment piece is coupled to an inner surface of the first flexible portion.

In aspects, a first end of the second rigid portion attaches to an inner surface of the first flexible portion, and a second end of the second rigid portion attaches to the ear tip.

In aspects, the first flexible portion has a constant thickness.

In aspects, the first flexible portion comprises a first end proximate to the earbud housing and a second end proximate to the second rigid portion, and the first end is thicker than the second end.

In aspects, the earbud housing is shaped to fit in the lower concha of the user. In aspects, the earbud housing comprises a front housing and a top housing, and an acoustic driver module is mounted in the front housing. In aspect, the top housing is shaped to fit in the lower concha of the user. In aspects, the front housing and the top housing are made of a more rigid material than the nozzle portion of the earbud housing.

Certain aspects provide an in-ear audio device comprising an earbud housing comprising a nozzle portion, wherein the nozzle portion comprises a first flexible portion and a second rigid portion, the first flexible portion extends a section of the earbud housing towards an ear canal of a user, and the second rigid portion couples a removable sealing structure to the earbud housing.

In aspects, the removable sealing structure comprises a substantially spherical dome-shaped sealing structure.

In aspects, the in-ear audio device further comprises a feedback microphone mounted on an inner surface of the second rigid portion. In aspects, the in-ear audio device further comprises an acoustic driver acoustically coupled to the feedback microphone and mounted on the inner surface the second rigid portion.

In aspects, the in-ear audio device further comprises an acoustic driver mounted in the earbud housing.

In aspects, in-ear audio device further comprises a rigid attachment piece coupling the first flexible portion to the earbud housing, wherein the rigid attachment piece is coupled to an inner surface of the first flexible portion.

In aspects, a first end of the second rigid portion attaches to an inner surface of the first flexible portion, and a second end of the second rigid portion attaches to the removable sealing structure.

In aspects, the earbud housing is shaped to fit in the lower concha of the user, and the earbud housing is made of material that is more rigid than the first flexible portion.

All examples and features mentioned herein can be combined in any technically possible manner. Other features, objects, and advantages will become apparent from the following detailed description, when read in connection with the following drawing.

DETAILED DESCRIPTION

Current ANR in-ear audio devices have a long, rigid nozzle that couples an earbud housing to a sealing structure. The rigid nozzle allows a feedback microphone, used for ANR, to sit deeper in the user's ear canal. A feedback microphone detects environmental noise and the detected environmental noise is used to create an equal and opposite anti-noise to nearly eliminate external noise before it enters the user's ear canal. While the rigid nozzle allows the feedback microphone to be positioned close to the user's ear canal, it creates some challenges for achieving a comfortable fit for varying ear sizes and geometries.

Aspects of the present disclosure provide a nozzle that has both a flexible portion and a rigid portion. The partially flexible, partially rigid nozzle creates an earbud housing that is able to be comfortably positioned in the user's ear for most ear geometries and sizes and also allows a feedback microphone to be placed deep in the user's ear canal to provide better ANR performance. The flexible portion of the nozzle allows the rigid portion and the sealing structure to flexibly align with a user's ear. The rigid portion of the nozzle allows a feedback microphone and optionally an acoustic driver to be mounted close to the user's ear canal. In aspects, the earbud housing takes advantage of the space in the user's conchal bowl to house electronics. Accordingly, in some examples, the feedback microphone is mounted on an interior portion of the rigid part of the nozzle and is acoustically coupled to an acoustic driver that is mounted in the earbud housing. The described nozzle structure helps the in-ear audio device comfortably sit in the wearer's ear for long periods of time while providing robust ANR functionality.

The appended figures and corresponding description illustrate one or more of the earbud housing or the in-ear audio device for a wearer's right ear. An earbud housing and an in-ear audio device that is designed to fit in the wearer's left ear is a mirror image of the earbud housing and in-ear audio device described herein, and operates according to the same principles.

Figure 1A:
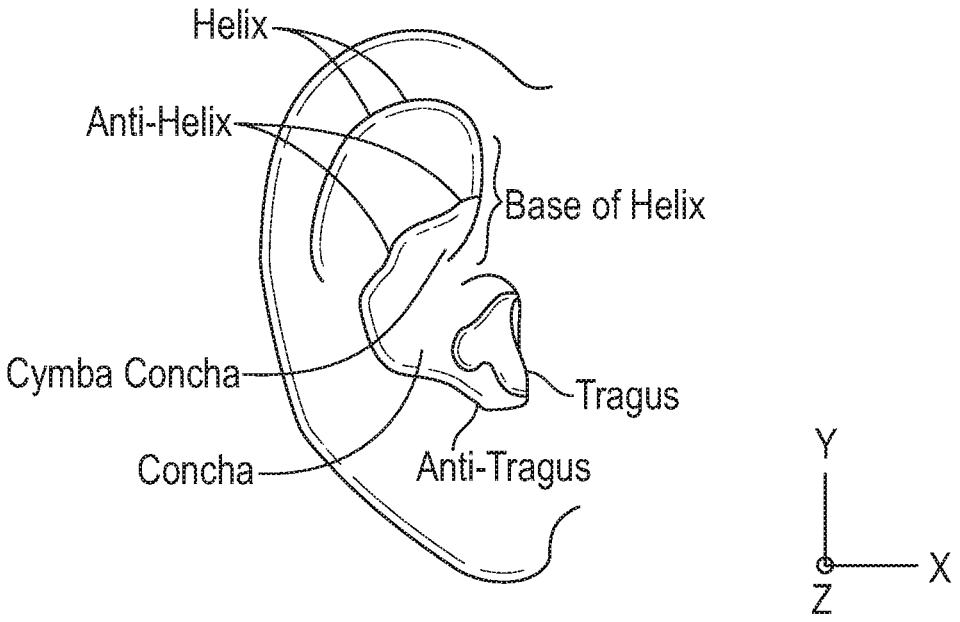
FIG. 1A is a view of the lateral surface of the human ear.

FIG. 1A shows the lateral surface of a human right ear, with some features identified. There are many different ear sizes and geometries. Some ears have additional features that are not shown in FIG. 1A. Some ears lack some of the features that are shown in FIG. 1A. Some features may be more or less prominent than are shown in FIG. 1A.

Figure 1B:
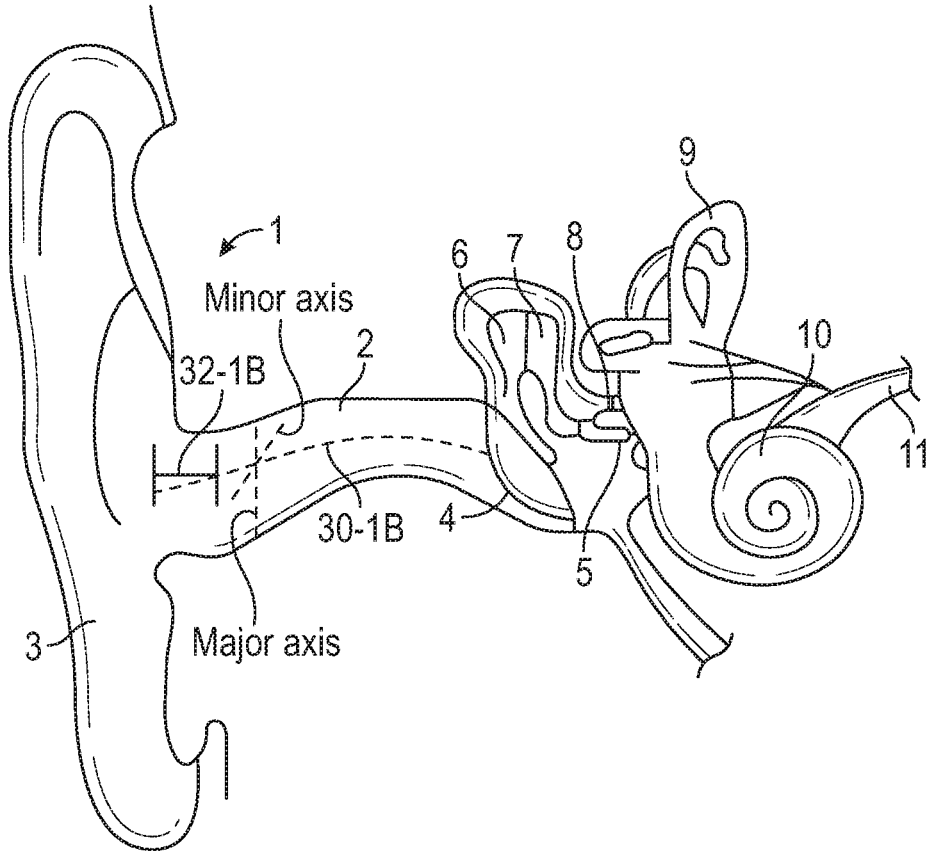
FIGS. 1B and 1C are exemplary cross-sections of the human ear.
Figure 1C:
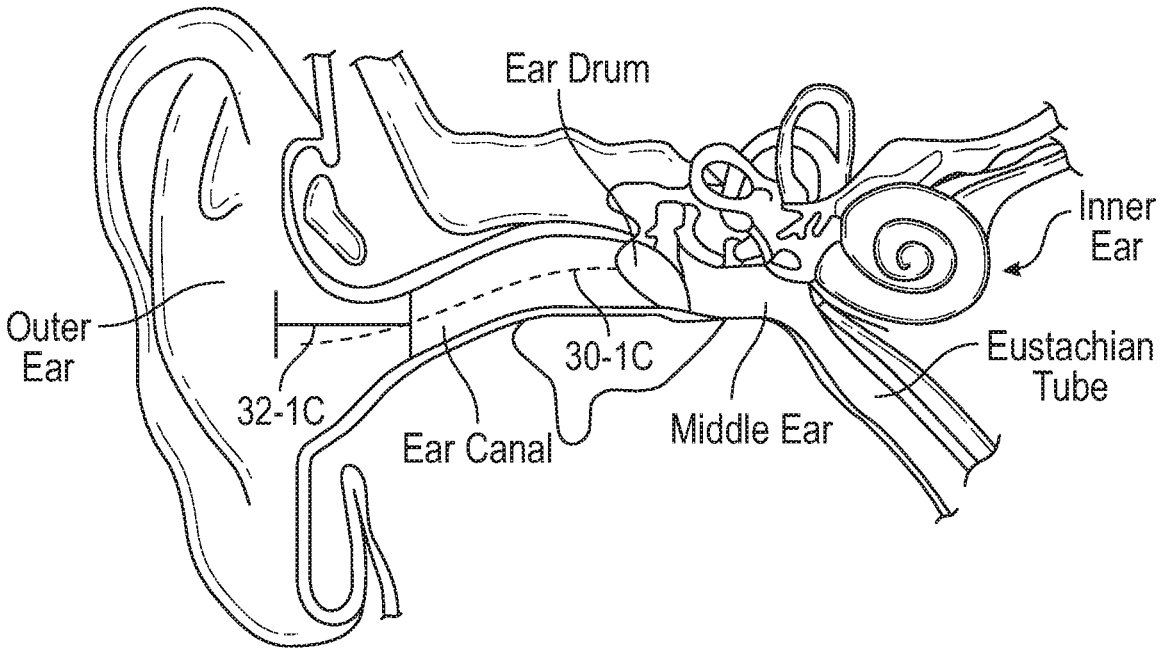

FIGS. 1B and 1C show two exemplary cross-sections of the human ear, with some features identified. The ear canal is an irregularly shaped cylinder with a variable cross sectional area and a centerline that is not straight. Among the features identified is the entrance to the ear canal and the main portion of the ear canal. In this specification, the entrance to the ear canal refers to the portion of the ear canal near the concha where the walls of the ear canal are substantially non-parallel to the centerline of the ear canal. The precise structure of the human ear varies widely from individual to individual. For example, in the cross section of FIG. 1B, there is a relatively sharp transition from ear canal walls that are non-parallel to a centerline 30-1B of the ear canal to walls that are substantially parallel to a centerline of the ear canal, so the entrance 32-1B to the ear canal is relatively short. In the cross-section of FIG. 1C, there is a more gradual transition from walls that are non-parallel to a centerline of the ear canal to walls that are substantially parallel to a centerline 30-1C of the ear canal, so the entrance 32-1C to the ear canal is relatively long.

Figure 2:
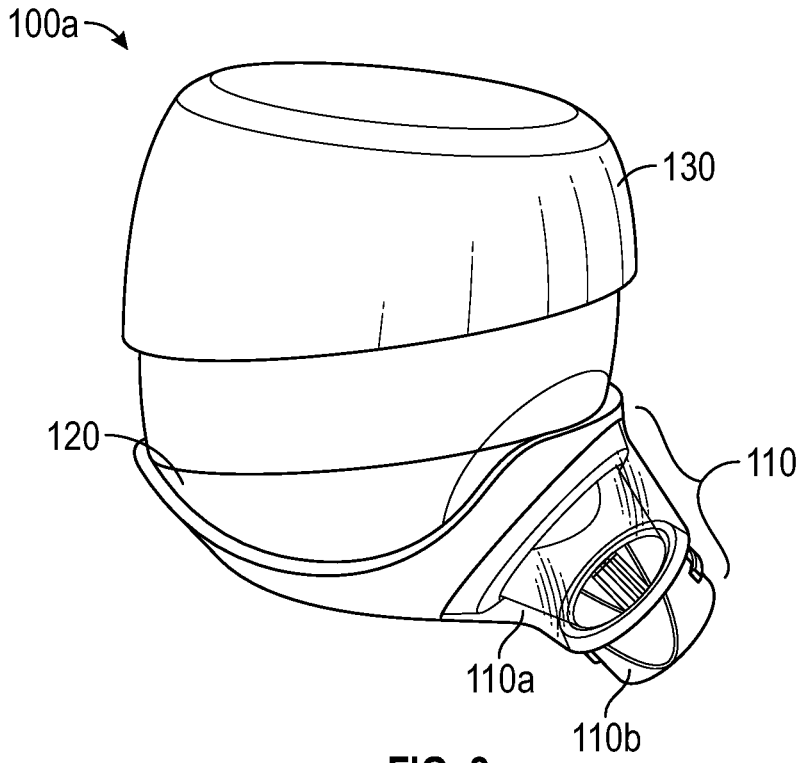
FIG. 2 is a side-view of an earbud housing of an in-ear audio device including a nozzle comprising a first flexible portion and a second rigid portion, according to aspects of the present disclosure.
Figure 3:
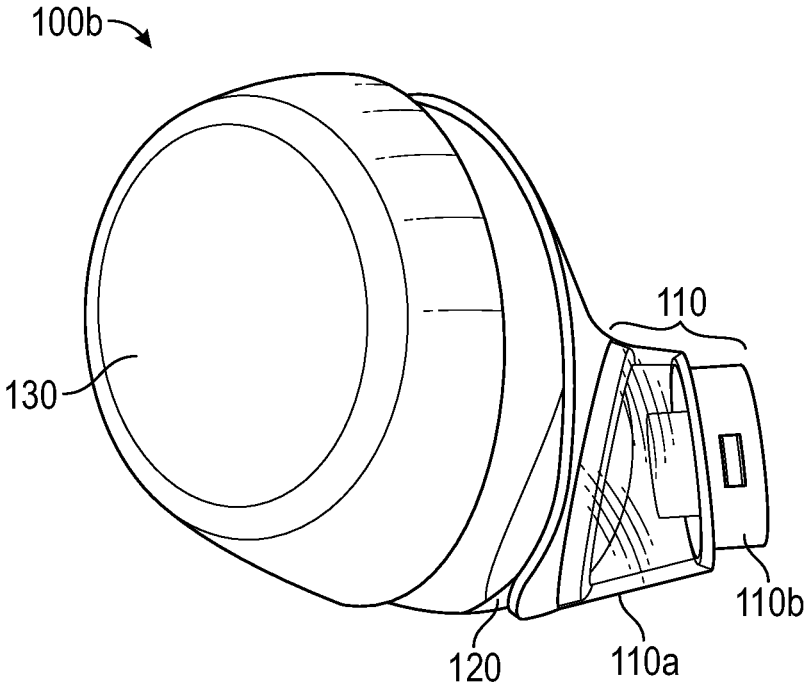
FIG. 3 is a front-view of the earbud housing of the in-ear audio device including the nozzle comprising the first flexible portion and the second rigid portion, according to aspects of the present disclosure.

FIG. 2 is a side-view 100*a* of an earbud housing of an in-ear audio device including a nozzle 110 comprising a first flexible portion 110*a* and a second rigid portion 110*b* and FIG. 3 is a front-view 100*b* of the earbud housing of the in-ear audio device including the nozzle 110 comprising the first flexible portion 110*a* and the second rigid portion 110*b*, according to aspects of the present disclosure.

Figure 4:
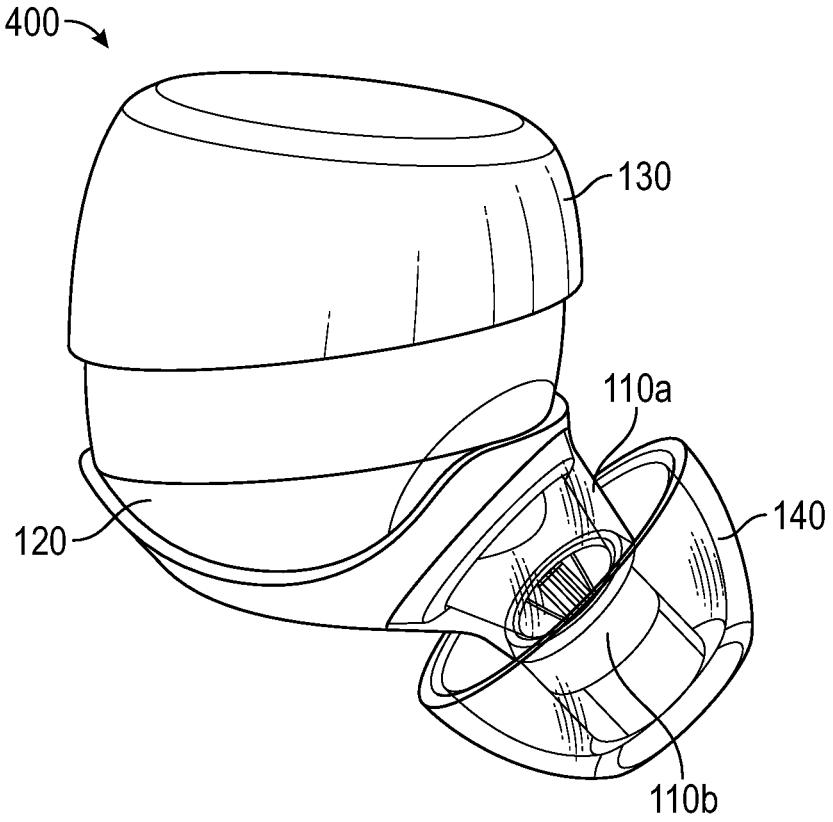
FIG. 4 is a side-view of the in-ear audio device including the earbud housing illustrated in FIGS. 2-3 and a sealing structure, according to aspects of the present disclosure.
Figure 5:
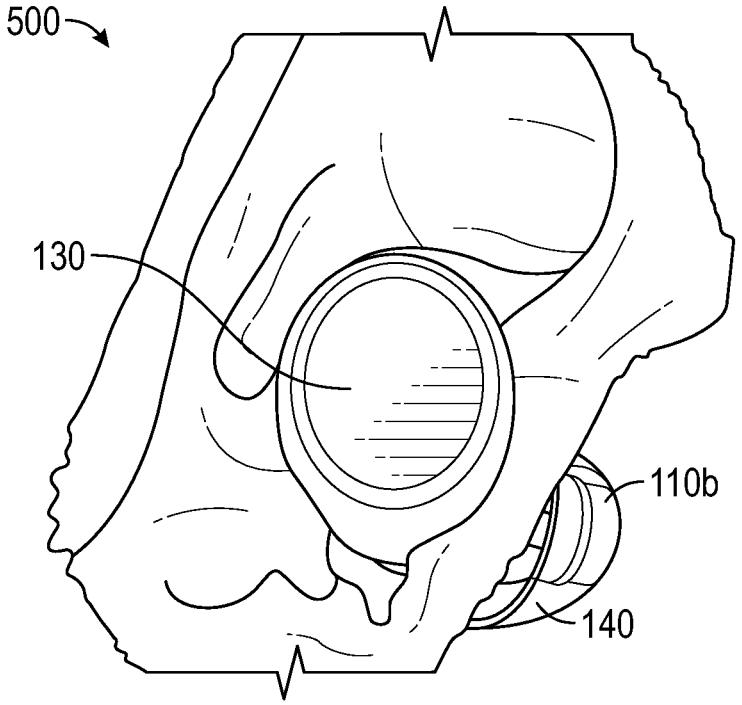
FIG. 5 is a side perspective view of the in-ear audio device positioned in a wearer's ear, according to aspects of the present disclosure.

The earbud housing includes a front housing 120, a top housing 130, and a nozzle 110 that extends the earbud housing towards the user's ear canal. The front housing 120 and the top housing 130 are shaped to fit in the lower concha of the wearer's ear. In one example, and as shown in FIG. 5, the front housing 120 is shaped to fit along the lower concha and in the conchal bowl. In aspects, an acoustic driver and other electronics are housed in one of the front housing 120 or the top housing 130. FIGS. 2-4 and 7 illustrate a front housing 120 and a top housing 130; however, the earbud housing need not have this specific design to house electronics for the in-ear audio device.

The nozzle 110 extends the earbud housing into the wearer's ear. The nozzle 110 extends from the earbud housing towards the sealing structure 140 (illustrated in FIG. 4). The nozzle 110 includes an acoustic passage for sound waves to pass to the ear canal of the wearer. As described herein, the nozzle 110 includes a first flexible portion 110*a* and a second rigid portion 110*b*. The flexible portion 110*a* and the rigid portion 110*b* are integrally formed. The first flexible portion 110*a* is proximate to the earbud housing and is coupled to the second rigid portion 110*b*. As illustrated in FIG. 4, the second rigid portion 110*b* couples an ear tip sealing structure 140 to the earbud housing. The second rigid portion 110*b* is less flexible than the flexible portion 110*a*. In aspects, the earbud housing is made of a material that is more rigid than the first flexible portion 110*a* and the second rigid portion 110*b*

The nozzle 110 is made of a biocompatible material. In an example, the nozzle is made of material having varying hardness. A higher durometer material is used for the rigid portion 110*b*, as less flexibility is desired as compared to the flexible portion 110*a*. Similarly, a lower durometer material is used for the flexible portion 110*a*, as increased flexibility is desired as compared to the rigid portion 110*b*.

In an example, the flexible portion 110*a* of the nozzle 110 has a constant thickness. In one example, the flexible portion 110*a* has a thickness of approximately 0.8 millimeters. In another example, the flexible portion 110*a* of the nozzle 110 has a varying thickness. In aspects, the flexible portion 110*a* gradually becomes thinner from the end proximate the earbud housing to the end coupled to the rigid portion 110*b*. As such, the thicker end of the flexible portion 110*a* is closer to the earbud housing and the thinner and more flexible end is proximate to the rigid portion 110*b*. FIGS. 6B-6D illustrate examples of the flexible nozzle portion 110*a* having a varying thickness. To protect the electronics housed in the earbud housing, as explained above, the earbud housing is made of a material that is more rigid than the nozzle 110.

FIG. 4 is a side-view 400 of the in-ear audio device including the earbud housing illustrated in FIGS. 2-3 and a sealing structure 140 and FIG. 5 is a side perspective view 500 of the in-ear audio device positioned in a wearer's ear, according to aspects of the present disclosure.

As described herein, an in-ear audio device includes an earbud housing (as illustrated in FIGS. 2-3) coupled to an ear tip sealing structure 140. The ear tip sealing structure 140 is coupled to the second rigid portion 110*b* of the nozzle 110. The sealing structure 140 creates a seal with a wearer's ear canal. The illustrated sealing structure 140 is substantially spherically-dome shaped; however, the sealing structure may be another shape such as umbrella or conical shaped.

In aspects, the sealing structure 140 includes a attachment piece 170 (shown in FIG. 7) that couples to the sealing structure to the second rigid portion 110*b*. The sealing structure extends around an outer circumferences of the second rigid portion 110*b*. The sealing structure 140 is coupled to the rigid portion 110*b* of the nozzle 110 and folds back towards the wearer's outer ear. In aspects, the sealing structure 140 is removable from the earbud housing. This allows a user to replace a damaged sealing structure or select an appropriately sized sealing structure.

As shown in FIG. 5, the top housing 130 is visible when the in-ear audio device is positioned in the wearer's ear. While not visible, it is understood that the front housing 120 is shaped to fit in the wearer's concha.

Figure 6A:
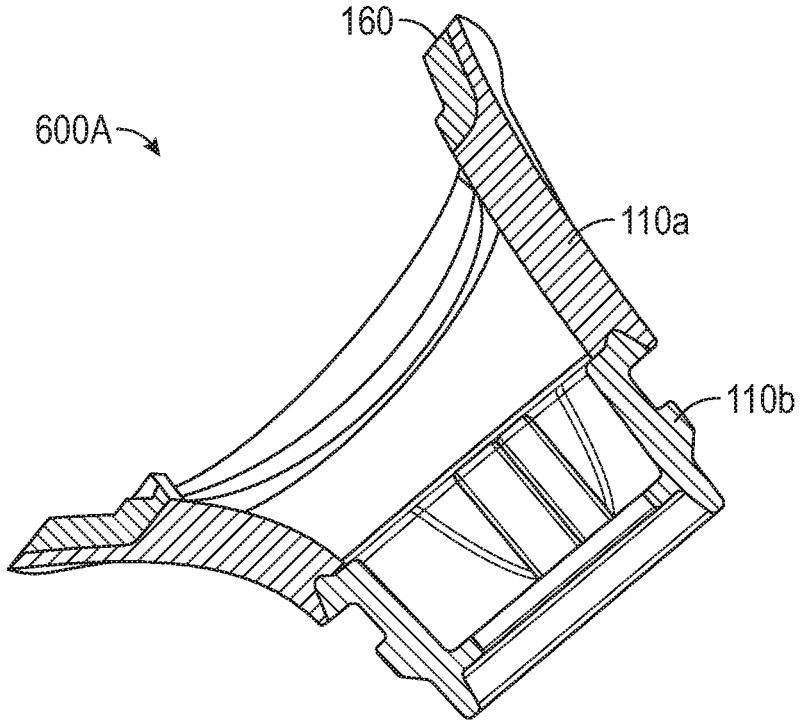
FIGS. 6A-6D are example cross-section views of the first flexible portion of the nozzle and second rigid portion of the nozzle, according to aspects of the present disclosure.
Figure 6B:
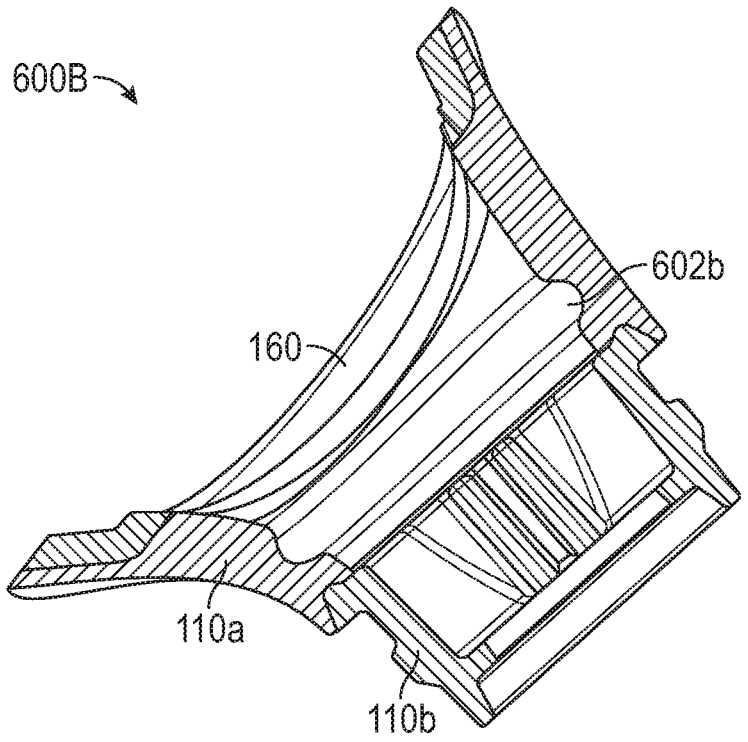
Figure 6C:
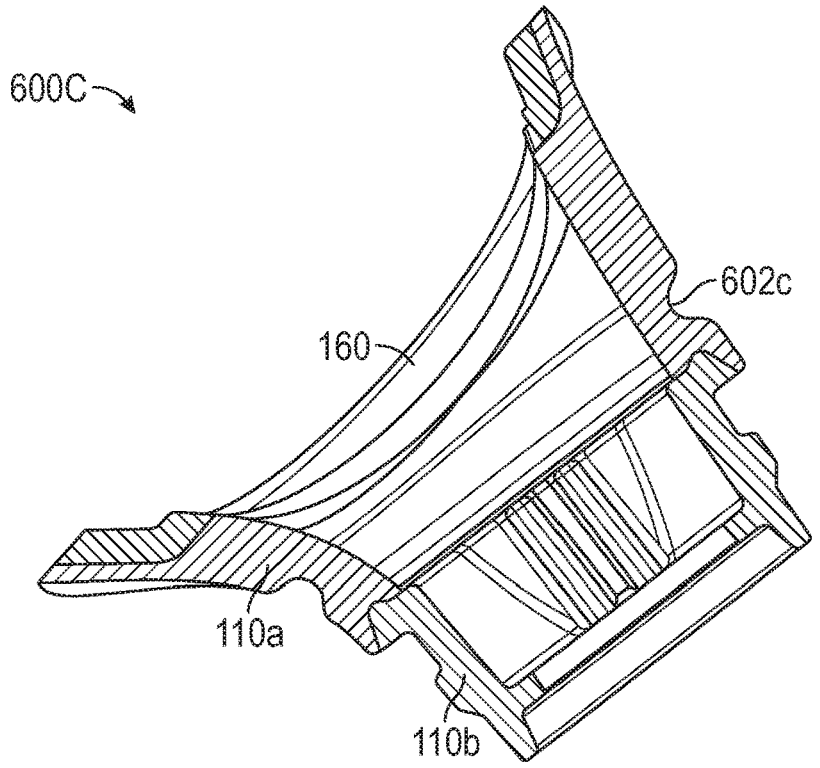
Figure 6D:
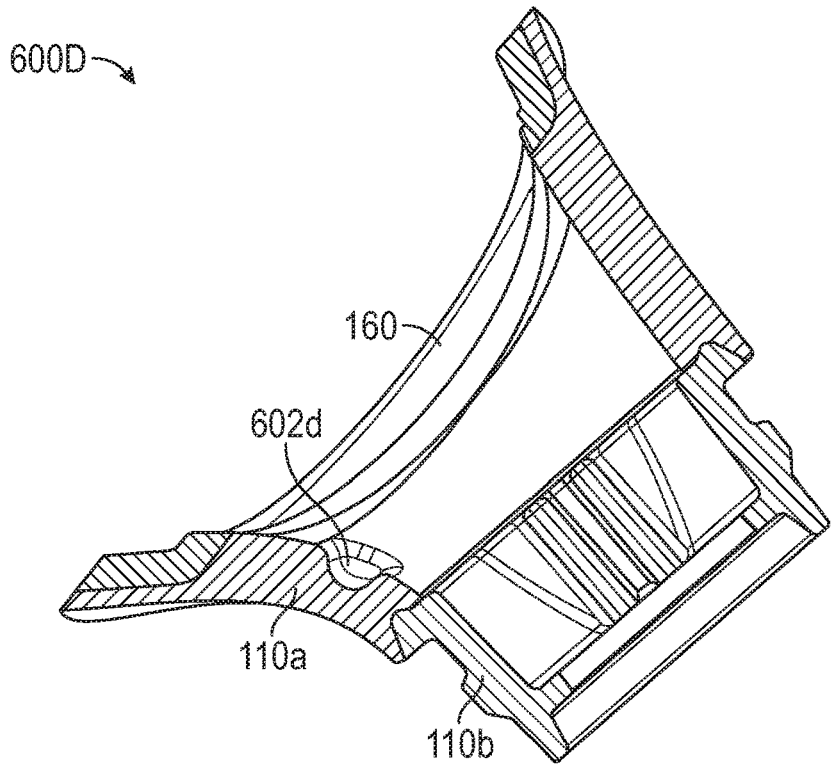

FIG. 6A is a cross-section view 600A of the first flexible portion 110*a* of the nozzle 110 and second rigid portion 110*b* of the nozzle 110, according to aspects of the present disclosure. A rigid attachment piece 160 couples the first flexible portion 110*a* to the earbud housing. Specifically, the attachment piece 160 couples the first end of the first flexible portion 110*a* to the earbud housing. The second end of the first flexible portion 110*a* is coupled to the second rigid portion 110*b*. In aspects, the rigid attachment piece 160 is made of plastic. In an example, the flexible portion 110*a* is molded over the attachment piece 160 at a first end, and molded over the rigid portion 110*b* at a second end. Accordingly, the end of the rigid portion 110*b* that is proximate to the flexible portion 110*a* of the nozzle 110 is attached to an inner surface of the flexible portion 110*a*, resulting in the flexible portion 110*a* joined or linked to the rigid portion 110*b*.

In FIG. 6A, the flexible portion 110*a* of the nozzle 110 is molded around an outer circumference of the rigid attachment piece 160. In this example, the attachment piece 160 is a ring that spans the inner circumference of the flexible portion 110*a*. The attachment piece 160 attaches to the front housing 120 (see FIG. 7). In an example, an adhesive attaches the attachment piece 160 to the front housing 120. As described above and as shown in FIG. 7, the attachment piece 170 of the sealing structure 140 couples the rigid portion 110*b* of the nozzle 110 to the sealing structure 140. In an example, the attachment piece 170 is a rigid plastic ring.

FIGS. 6B-6D illustrate example cross-section views 600B, 600C, and 600D, respectively of the flexible portion of the nozzle having a varying thickness. Relative to FIG. 6A, in each of FIGS. 6B-6D the flexible portion 110*a* has a varying localized thickness. In FIG. 6B, the flexible portion 110*a* includes an inside notch 602*b* along the interior surface. In an aspect, the inside notch 602*b* spans part of the inner circumference of the flexible portion 110*a*. In another aspect, the inside notch 602*b* spans the full inner circumference of the flexible portion 110*a*.

In FIG. 6C, the flexible portion 110*a* includes an exterior notch 602*c* along the exterior surface. In an aspect, the inside exterior notch 602*c* spans part of the exterior circumference of the flexible portion 110*a*. In another aspect, the exterior notch 602*c* spans the full outer circumference of the flexible portion 110*a*.

In FIG. 6D, the flexible portion 110*a* includes a localized notch 602*d* on an interior surface. While one localized notch 602*d* is illustrated, the flexible portion 110*a* may include multiple localized notch.

As described above, one end of the flexible portion 110*a* may be thicker than the other end. In one example, the thicker end of the flexible portion 110*a* is closer to the earbud housing and the thinner and more flexible end is closer to the rigid portion 110*b*. As illustrated in FIGS. 6B-6D, the thickness of the flexible portion is not constant due to the notches 602*b*, 602*c*, and 602*d* in the flexible portion 110*a* of the nozzle. In aspects, the flexible portion transitions from thicker to thinner moving from the earbud housing towards rigid portion 110*b* and further includes local changes or variations in thickness.

Varying the thickness of the flexible portion 110*a* by one or more of transitioning from thicker to thinner in the direction of the rigid portion, by including one or more of notches 602*b*, 602*c*, and 602*d*, or other variations in thickness of the flexible portion 110*a* of the nozzle encourages motion along the direction of the minor axis of the user's ear canal towards or away from the underside of the tragus while remaining stiff in the direction into and out of the user's ear.

A more flexible, softer, flexible portion 110*a* provides comfort and acoustic benefits. Variation in thickness of the flexible portion 110*a* enables flexibility in desired directions while maintaining stiffness in other directions to limit adverse acoustic impacts. Depending on ear geometry, it is desirable for the nozzle to flex and rotate upwards to apply less pressure on the concha floor. The increased flexibility allows the nozzle to better align with the user's ear geometry, resulting in the sealing structure 140 having a better seal with the ear canal. Additionally, the increased flexibility in the direction of the minor axis of the ear canal decreases the probability of the acoustic outlet being blocked off or being inefficiently delivered to the ear. By remaining stiff in the direction into an out of the user's ear, the sealing structure 140 more easily attaches to the rigid portion 110*b*.

Alternatively or in addition to varying the thickness of the flexible portion 110*a* in aspects, the flexible portion is made of viscoelastic material. The viscoelastic material stiffens as the frequency increases and helps limit the noise passed through the flexible portion.

Figure 7:
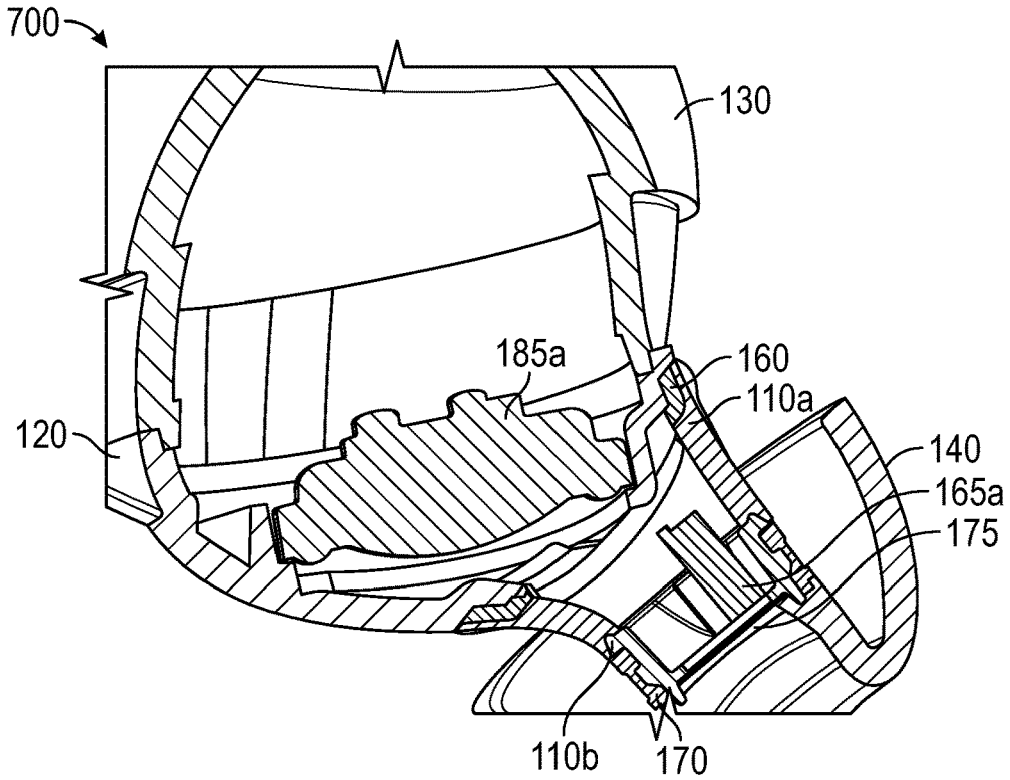
FIG. 7 is a cross-section view of the in-ear audio device including a feedback microphone mounted on an interior surface of the second rigid portion of the nozzle and an acoustic driver mounted in the earbud housing, according to aspects of the present disclosure.

FIG. 7 is a cross-section view 700 of the in-ear audio device including a feedback microphone 165*a* mounted on an interior surface of the second rigid portion 110*b* of the nozzle 110 and an acoustic driver 185*a* mounted in the earbud housing, according to aspects of the present disclosure. In one example, the acoustic driver 185*a* is mounted in the front housing 120.

The feedback microphone 165*a* is acoustically coupled to the acoustic driver 185*a*. The rigid portion 110*b* of the nozzle 110 facilitates an in-ear audio device including a feedback microphone that is placed in the user's ear canal. The flexible portion 110*a* of the nozzle 110 allows the sealing structure 140 to slightly flex approximately 10-20 degrees, primarily up and down when positioned in a wearer's ear. Accordingly, the nozzle 110 provides both flexibility, via the flexible portion 110*a* to achieve stability and proper orientation and structure, via the rigid portion 110*b*, to mount a feedback microphone closer to the user's ear.

In aspects, an attachment piece 170 of the sealing structure 140 couples the rigid portion 110*b* of the nozzle 110 to the sealing structure 140. In FIG. 7, the attachment piece 170 is a ring that attaches to an outer circumference of the rigid portion 110*b* of the nozzle 110. In aspects, an acoustic mesh 175 spans the opening between the rigid portion of the nozzle 110*b* and the sealing structure 140.

Figure 8:
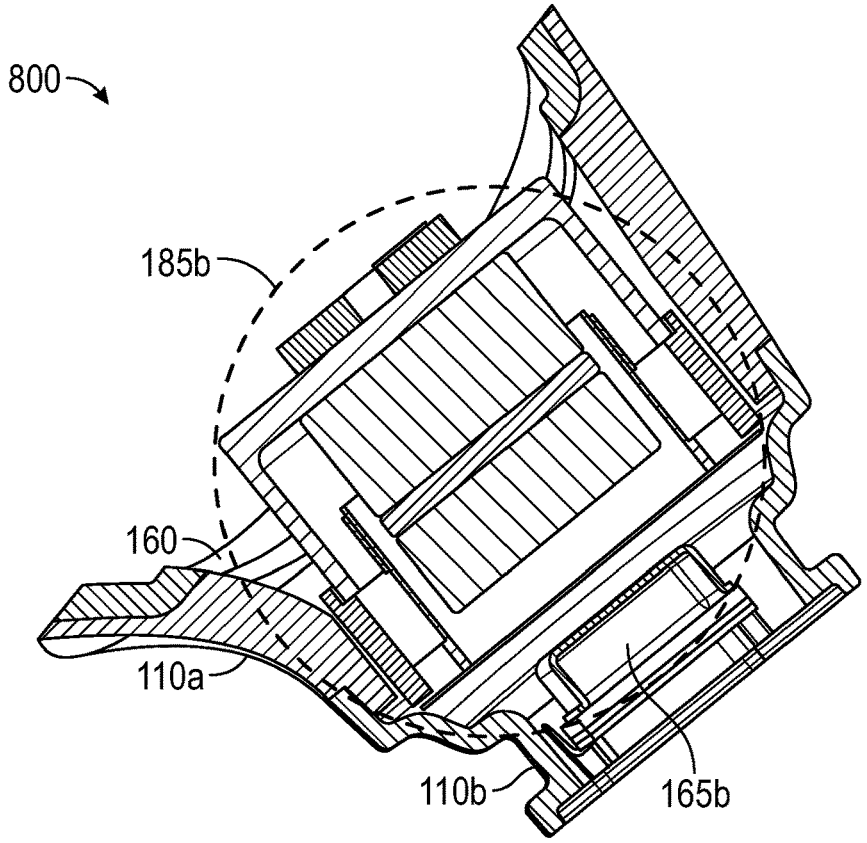
FIG. 8 is cross-section view of a feedback microphone and an acoustic driver both mounted on an interior surface of the second rigid portion of the nozzle, according to aspects of the present disclosure.

FIG. 8 is cross-section view 800 of a feedback microphone 165*b* and an acoustic driver 185*b* mounted on an interior surface of the second rigid portion 110*b* of the nozzle 110, according to aspects of the present disclosure. In aspects, both the feedback microphone 165*b* and the acoustic driver 185*b* are mounted on an inner surface of the rigid portion 110*b* of the nozzle. Similar to FIG. 7, the feedback microphone 165*b* is acoustically coupled to the acoustic driver 185*b*.

As described herein, an in-ear audio device includes an earbud housing with a flexible component. Specifically, the nozzle 110 has flexible portion 110*a* and a rigid portion 110*b*. The in-ear audio device provides ANR using a feedback microphone 165*a*, 165*b* that is attached to a rigid portion 110*b* of the nozzle 110 that is in the user's ear canal and close to the user's ear drum. Placing the feedback microphone close to the user's eardrum provides robust ANR functionality. Additionally, the nozzle includes a flexible portion 110*a* that allows the sealing structure 140 and the rigid portion 110*b* of the nozzle to comfortably accommodate the shape and size of the user's ear while maintaining proper orientation of the audio device when positioned in the user's ear. As described, the feedback microphone 165*a*, 165*b* is attached to the rigid portion of the nozzle 110*b* and the acoustic driver is attached to the rigid portion 110*b* of the nozzle or attached to the earbud housing. The earbud housing has space to accommodate the acoustic transducer 185*b* and other electronics because the earbud housing is designed to sit in the concha of the user's ear.

The earpiece described herein is applicable to a variety of devices, including audio headphones, hearing aids, hearing assistance headphones, noise-masking earbuds, ANR headphones, aviation headphones, and other devices that include an in-ear component.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An in-ear audio device comprising:
an ear tip;
an earbud housing; and
a nozzle coupled to an external surface of the earbud housing and extending from the earbud housing, wherein the nozzle comprises a first flexible portion and a second rigid portion;
the first flexible portion extends the nozzle towards an ear canal of a user and comprises a first end proximate to the earbud housing and a second end proximate to the second rigid portion, wherein the first end is thicker than the second end to encourage motion along a direction of a minor axis of the ear canal of the user; and
the second rigid portion couples the ear tip to the earbud housing.

2. The in-ear audio device of claim 1, further comprising:
a feedback microphone mounted on an inner surface of the second rigid portion.

3. The in-ear audio device of claim 2, further comprising:
an acoustic driver acoustically coupled to the feedback microphone and mounted on the inner surface of the second rigid portion.

4. The in-ear audio device of claim 2, further comprising:
an acoustic driver mounted in the earbud housing.

5. The in-ear audio device of claim 1, further comprising:
a rigid attachment piece coupling the first flexible portion to the external surface of the earbud housing, wherein the rigid attachment piece is coupled to an inner surface of the first flexible portion.

6. The in-ear audio device of claim 5, wherein the rigid attachment piece coupling the first flexible portion to the external surface of the earbud housing comprises a ring.

7. The in-ear audio device of claim 1, wherein:
a first end of the second rigid portion attaches to an inner surface of the first flexible portion; and
a second end of the second rigid portion attaches to the ear tip.

8. The in-ear audio device of claim 1, wherein the earbud housing is shaped to fit in the lower concha of the user.

9. The in-ear audio device of claim 8, wherein:
the earbud housing comprises a front housing and a top housing, and
an acoustic driver module is mounted in the front housing.

10. The in-ear audio device of claim 9, wherein the top housing is shaped to fit in the lower concha of the user.

11. The in-ear audio device of claim 9, wherein the front housing and the top housing are made of a more rigid material than the nozzle of the earbud housing.

12. An in-ear audio device comprising:
an earbud housing; and
a nozzle coupled to an external surface of the earbud housing and extending from the earbud housing, wherein the nozzle comprises a first flexible portion and a second rigid portion;
the first flexible portion extends the nozzle towards an ear canal of a user and comprises a first end proximate to the earbud housing and a second end proximate to the second rigid portion, wherein the first end is thicker than the second end to encourage motion along a direction of a minor axis of the ear canal of the user; and
the second rigid portion couples a removable sealing structure to the earbud housing.

13. The in-ear audio device of claim 12, wherein the removable sealing structure comprises a substantially spherical dome shaped sealing structure.

14. The in-ear audio device of claim 12, further comprising:
a feedback microphone mounted on an inner surface of the second rigid portion.

15. The in-ear audio device of claim 14, further comprising:
an acoustic driver acoustically coupled to the feedback microphone and mounted on the inner surface the second rigid portion.

16. The in-ear audio device of claim 14, further comprising:
an acoustic driver mounted in the earbud housing.

17. The in-ear audio device of claim 12, further comprising:

a rigid attachment piece coupling the first flexible portion to the external surface of the earbud housing, wherein the rigid attachment piece is coupled to an inner surface of the first flexible portion.

18. The in-ear audio device of claim 12, wherein:

a first end of the second rigid portion attaches to an inner surface of the first flexible portion; and a second end of the second rigid portion attaches to the removable sealing structure.

19. The in-ear audio device of claim 12, wherein:

the earbud housing is shaped to fit in the lower concha of the user, and the earbud housing is made of material that is more rigid than the first flexible portion.

20. The in-ear audio device of claim 17, wherein the rigid attachment piece coupling the first flexible portion to the external surface of the earbud housing comprises a ring.

* * * * *